United States Patent [19]

Iyer et al.

[11] 4,341,456

[45] Jul. 27, 1982

[54] TRANSFER SYSTEM FOR A XEROGRAPHIC REPRODUCTION MACHINE

[75] Inventors: Venkat K. Iyer, Webster; Stephen Borostyan, Victor; Timothy T. Blair, Farmington, all of N.Y.

[73] Assignee: Xerox Corporation, Stamford, Conn.

[21] Appl. No.: 163,459

[22] Filed: Jun. 27, 1980

[51] Int. Cl.[3] ..... G03G 15/00

[52] U.S. Cl. ..... 355/3 TR

[58] Field of Search ..... 355/3 TR, 3 TE; 430/126

[56] References Cited

U.S. PATENT DOCUMENTS 3,691,993 9/1972 Krause et al. ..... 355/3 TR

FOREIGN PATENT DOCUMENTS 55-29839 3/1980 Japan ..... 355/3 TR

*Primary Examiner*—Richard L. Moses

[57] ABSTRACT

With the advent of low volume, low cost desk top copiers, a low cost transfer system is needed. The present invention uses a brush having conductive bristles, and a low voltage source, the brush being mounted adjacent to, but not in contact with a photoreceptor. A copy sheet is directed toward the bristles to deflect the bristles so that the bristles are in contact with the back side of the copy sheet as it contacts the toner image on the photoreceptor. Immediately before the trailing edge of the copy sheet moves out of contact with the photoreceptor, the brush is returned to its original position without contacting the photoreceptor.

3 Claims, 3 Drawing Figures

12
26
14
16
28
20
22
10
32
34
24
18
36

TRANSFER SYSTEM FOR A XEROGRAPHIC REPRODUCTION MACHINE

BACKGROUND OF THE INVENTION

The present invention relates to an improved transfer system for transferring a toner image from a photoreceptor to a copy sheet, but more particularly to a low voltage intermittent contact system using a brush to effect transfer.

With the introduction of small copiers for the low volume end of the copier market, it has become increasingly important to minimize both the cost and the complexity of the copiers. Transfer is a critical step in plain paper xerography. Larger copiers and duplicators presently use transfer systems which use either corona generating devices or electrically biased rollers. With a corona generating device, the copy sheet has a charge deposited on it by the corona generating device. A corona generating device requires high voltages generally in excess of 5000 volts for its operation which generates significant amounts of ozone, especially in the negative mode. Collecting and filtering ozone adds to the cost of the copier as does the cost of the power supply for the corona generating device. Thus, what is needed, is an effective transfer system which is economical, does not require a large power supply, and does not generate excessive ozone.

SUMMARY OF THE INVENTION

The primary object of the present invention is to reduce the cost, size, and complexity of a transfer system for a small copier. The present transfer system uses a brush having conductive bristles positioned adjacent to, but out of contact with a photoreceptor. Means are used to direct a lead edge of a copy sheet toward said bristles to deflect the bristles and cause the same to remain in contact with the back of the copy sheet as the latter is moved into contact with a toner image on a photoreceptor so that the transfer of the toner image is effected. Means are used to detect when the trailing edge of the paper is about to move out of contact with the photoreceptor and cause the brush bristles to be moved out of contact at that point with the copy sheet.

BRIEF DESCRIPTION OF THE DRAWINGS

Referring to FIG. 1, the operation of the present invention will now be described in detail. A transfer system 10 is mounted adjacent to but out of contact with a photoreceptor 12, the latter containing a toner image which is to be transferred to a copy sheet. A copy sheet 14 is moved toward the photoreceptor 12 by a pair of pinch rollers 16 and 18. The transfer system includes a brush 20 having conductive bristles 22 for effecting transfer. Assuming that negative toner is used in this particular environment, the conductive bristles 22 are electrically biased by a positive voltage source 24. As can be seen, the leading edge of copy sheet 14 will deflect the bristles 22 causing them to bend to the dotted line position 26 and contact the back side of the paper as the latter is moved into contact with the toner image on the photoreceptor 12. Because the brush bristles 22 are in direct contact with the back side of the copy sheet 14, a low cost, low voltage source 24, e.g., approximately 1000 volts, may be used instead of a typical high voltage source of 5000 to 6000 volts for a conventional corona generating device.

The advantage of using an arrangement such as this as compared to a corona generating device is not only that the present system is much more economical, but also it is much more efficient. In a corona generating device, only about one-fifth of the total current generated is used to effect transfer, thus, it is relatively inefficient. With the present arrangement, all or essentially all of the current that is generated is delivered to the copy sheet to effect transfer. Also, as stated above, a considerable amount of ozone is generated in a corona generating arrangement as opposed to the present invention. Also, because the leading edge of the paper deflects the bristles, only those bristles that are needed to effect transfer will be used. In other words, various widths of paper can be used without bringing bristles into contact with the photoreceptor.

Because the bristles 22 are electrically biased, it is not desirable to have the bristles contact the photoreceptor since they will collect toner which will be passed onto subsequent copy sheets passing through the copier. As the copy sheet 14 continues its movement toward the photoreceptor into contact with the toner image thereon, a light sensing device 28 is used to detect the trailing edge of the copy sheet 14.

Figure 1:
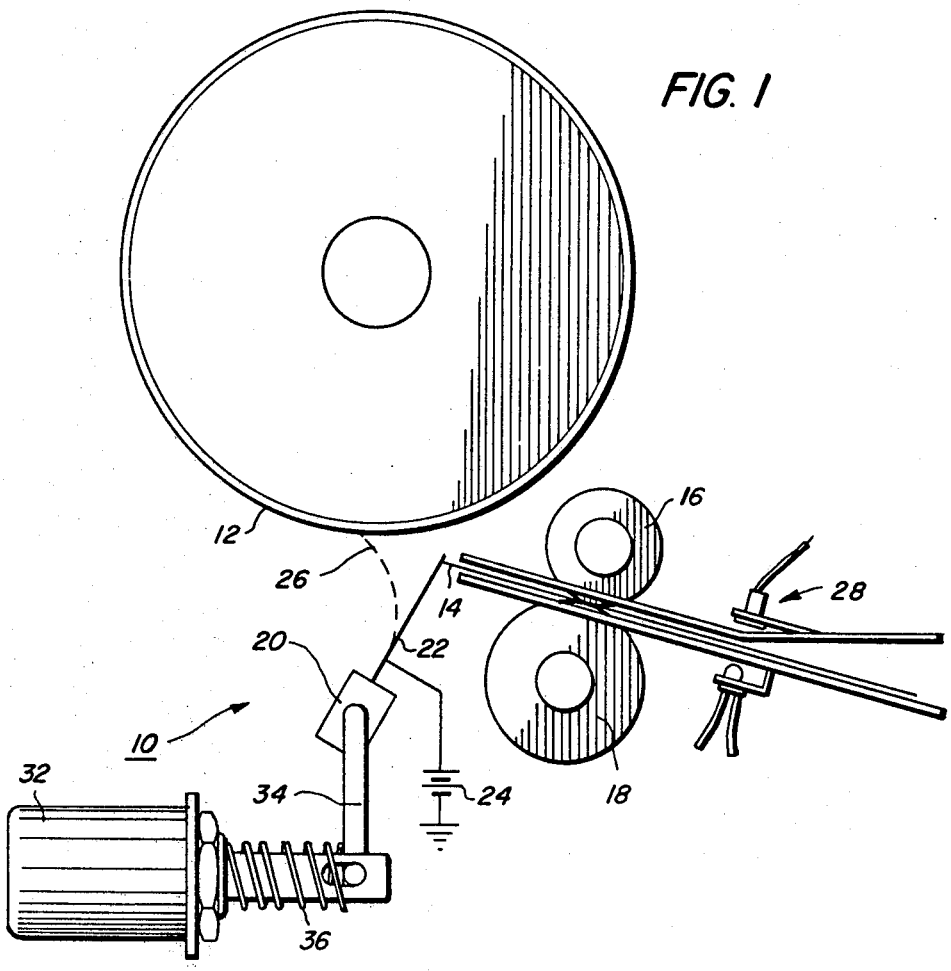
FIG. 1 is a schematic sectional view of the preferred embodiment of the present invention mounted adjacent to a photoreceptor.
Figure 2:
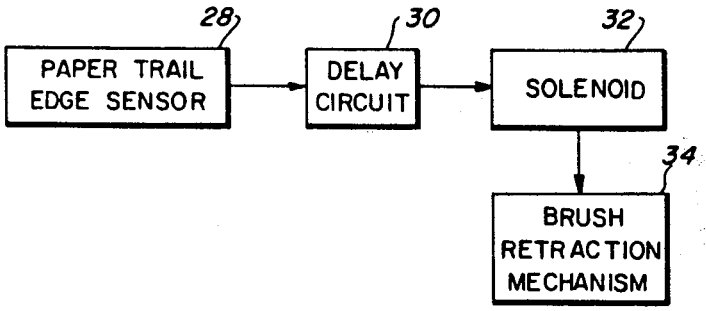
FIG. 2 is a block diagram showing the major components of a brush decaming system.

Referring to FIG. 2, it can be seen that upon detection of the trailing edge of the copy sheet 14, a signal is sent to a delay circuit 30, the latter serving to send a delayed signal to solenoid 32 to cause the solenoid to be momentarily actuated to move the bristles 22 out of contact with the back side of the copy sheet 14 immediately before the trailing edge of the copy sheet moves out of contact with the photoreceptor. This should be effected approximately the last one-eighth to one-sixteenth of the length of the copy sheet. As stated above, it is not desired that the brush bristles contact the photoreceptor. Actuation of the solenoid 32 causes the brush retraction mechanism to be momentarily moved to the left as viewed in FIG. 1. This causes the brush 20 to rotate clockwise as viewed in FIG. 1 because the brush is fixed to a shaft (not shown) which is rotatably mounted in a stationary frame (not shown), and the brush retraction mechanism 34 is fixed to this shaft thereby causing both the shaft and brush to rotate. After this momentary actuation of the solenoid 32, spring 36 (see FIG. 1) returns the brush retraction mechhanism to the right with the bristles 22 in the solid line position.

Figure 3:
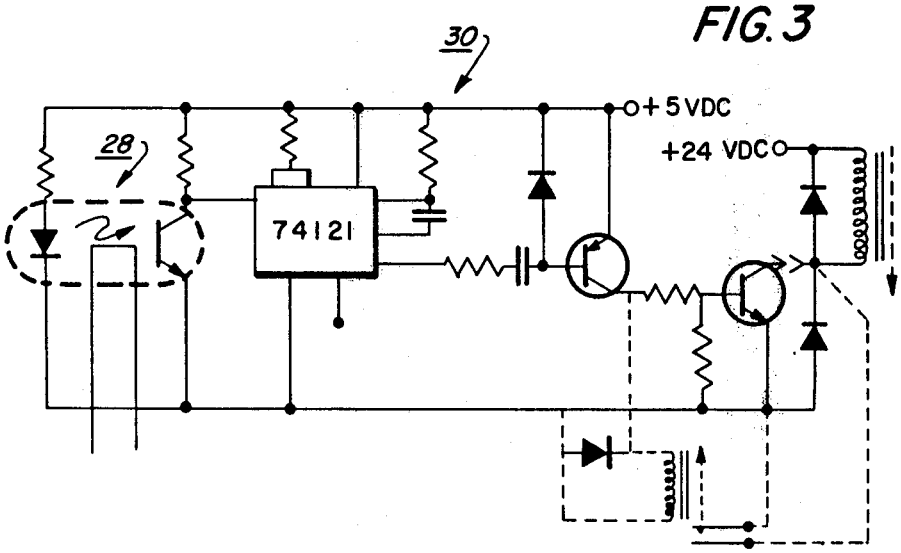
FIG. 3 is a detailed view of a sensor and delay circuit shown in FIG. 2.

Any suitable delay circuit 30 may be used to actuate the solenoid 32. FIG. 3 shows a circuit using a 74121 logic chip which is suitable for effecting this result.

While the invention has been described with reference to the structure disclosed, it is not confined to the details set forth, but is intended to cover such modifications, or changes as may come within the scope of the following claims.

We claim:

1. An improved transfer apparatus for transferring a toner image from a photoreceptor to a copy sheet, said transfer apparatus comprising:

a brush having conductive bristles positioned adjacent to but out of contact with the photoreceptor, means for electrically biasing the bristles, and means for causing the lead edge of the copy sheet to deflect the brush fibers after which the brush fibers contact the back of the copy sheet and remain in contact with the back of the copy sheet as the copy sheet is moved into contact with the toner image on the photoreceptor so that transfer of the toner image is effected.

2. An improved transfer system as set forth in claim 1 which further includes means for moving the bristles out of contact with the back of the copy sheet immediately before the trailing edge of the copy sheet moves out of contact with the photoreceptor.

3. An improved transfer system as set forth in claim 2 wherein the moving means includes means for sensing the trailing edge of the copy sheet at a particular location and in response thereto sending a delayed signal to cause the bristles to move out of contact with the back of the copy sheet immediately before the trailing edge of the copy sheet moves out of contact with the photoreceptor.

* * * * *